US009636534B2

(12) United States Patent
Yang et al.

(10) Patent No.: US 9,636,534 B2
(45) **Date of Patent: *May 2, 2017**

(54) APPARATUS, SYSTEM, AND METHOD FOR A FITNESS STICK

(71) Applicants: Li Si Yang, Honolulu, HI (US); Michael Grech, Honolulu, HI (US)

(72) Inventors: Li Si Yang, Honolulu, HI (US); Michael Grech, Honolulu, HI (US)

( * ) Notice: Subject to any disclaimer, the term of this patent is extended or adjusted under 35 U.S.C. 154(b) by 42 days.

This patent is subject to a terminal disclaimer.

(21) Appl. No.: 14/710,386

(22) Filed: May 12, 2015

(65) Prior Publication Data

US 2015/0238794 A1 Aug. 27, 2015

Related U.S. Application Data

(63) Continuation of application No. 13/346,583, filed on Jan. 9, 2012, now Pat. No. 9,028,379, which is a (Continued)

(51) Int. Cl.
*A63B 21/02* (2006.01)
*A63B 21/045* (2006.01)
(Continued)

(52) U.S. Cl.
CPC ..... *A63B 21/00* (2013.01); *A63B 21/0004* (2013.01); *A63B 21/00192* (2013.01); (Continued)

(58) Field of Classification Search
CPC ..... A63B 21/0004; A63B 21/00043; A63B 21/00185; A63B 21/00192; A63B 21/012; A63B 21/0125; A63B 21/018; A63B 21/02; A63B 21/055; A63B 21/0552; A63B 21/00; A63B 21/0407; A63B 21/0428; A63B 21/0435; A63B 21/0557; A63B 21/06; A63B 21/4035; A63B 21/4045;
(Continued)

(56) References Cited

U.S. PATENT DOCUMENTS 1,956,498 A 4/1934 Duke
2,621,043 A 12/1952 Olmstead
(Continued)

FOREIGN PATENT DOCUMENTS

JP 2000176044 6/2000
JP 2007195904 8/2007
(Continued)

*Primary Examiner* — Joshua Lee
(74) *Attorney, Agent, or Firm* — Kunzler Law Group

(57) ABSTRACT

An apparatus and system are disclosed for a fitness stick. The apparatus includes an elongated rod, a first track, and a second track. The elongated rod has a center point, a first end, and a second end. The first track extends helically away from the center point along an outer surface of the elongated rod toward the first end. The second track extends helically away from the center point along the outer surface of the elongated rod toward the second end. The first track extends helically around the outer surface of the elongated rod in a first rotational direction and the second track extends helically around the outer surface of the elongated rod in a second rotational direction. The second rotational direction is opposite from the first rotational direction.

12 Claims, 11 Drawing Sheets

Related U.S. Application Data continuation-in-part of application No. 12/822,014, filed on Jun. 23, 2010, now Pat. No. 8,092,353.

(60) Provisional application No. 61/219,675, filed on Jun. 23, 2009.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/12*** | (2006.01) |
| ***A63B 23/035*** | (2006.01) |
| *A63B 21/06* | (2006.01) |
| *A63B 23/00* | (2006.01) |

(52) U.S. Cl.

CPC ..... *A63B 21/0428* (2013.01); *A63B 21/0552* (2013.01); *A63B 21/4035* (2015.10); *A63B 23/03541* (2013.01); *A63B 23/12* (2013.01); *A63B 23/1209* (2013.01); *A63B 21/0557* (2013.01); *A63B 21/06* (2013.01); *A63B 21/4045* (2015.10); *A63B 23/03533* (2013.01); *A63B 2023/006* (2013.01); *A63B 2210/50* (2013.01)

(58) Field of Classification Search

CPC ..... A63B 21/4049; A63B 23/03533; A63B 23/03541; A63B 23/12; A63B 23/1209; A63B 23/14; A63B 2023/006; A63B 2209/08; A63B 2210/50

USPC ..... 482/44–51, 74, 91–94, 97–98, 106–110, 482/114–116, 118–119, 121–122, 124, 482/126–128, 131, 132, 139, 148; D21/662, 672, 674, 679–682, 684, D21/692–693

See application file for complete search history.

(56) References Cited

U.S. PATENT DOCUMENTS

| | | | |
|---|---|---|---|
| 3,761,083 | A | 9/1973 | Buchner |
| 3,971,255 | A | 7/1976 | Varney et al. |
| 4,036,490 | A | 7/1977 | Rice |
| 4,193,593 | A | 3/1980 | Wilson |
| 4,643,417 | A | 2/1987 | Nieman |
| 4,695,049 | A | 9/1987 | Ciemiega |
| 4,913,417 | A | 4/1990 | Francu |
| 4,955,603 | A | 9/1990 | Becker |
| 5,029,847 | A | 7/1991 | Ross |
| 5,152,731 | A | 10/1992 | Troutman |
| 5,190,512 | A | 3/1993 | Curran |
| 5,300,002 | A | 4/1994 | Freye |
| 5,328,431 | A | 7/1994 | Winslow |
| 5,536,227 | A | 7/1996 | Polchek et al. |
| 5,577,827 | A | 11/1996 | Leffingwell et al. |
| 5,820,531 | A | 10/1998 | Choi |
| 5,839,996 | A | 11/1998 | Gooding |
| 5,907,883 | A | 6/1999 | Thomasson |
| 7,022,046 | B2 | 4/2006 | Kim |
| 7,086,999 | B2 | 8/2006 | Jeneve et al. |
| 7,175,575 | B1 | 2/2007 | Dantolen |
| 7,314,438 | B1 | 1/2008 | Clark et al. |
| 7,465,259 | B2 | 12/2008 | Mok |
| 2005/0187079 | A1 | 8/2005 | Diakonov et al. |
| 2005/0202942 | A1 | 9/2005 | De Lano |
| 2007/0184941 | A1 | 8/2007 | Krietzman |
| 2008/0064574 | A1 | 3/2008 | Nardone |
| 2008/0202317 | A1 | 8/2008 | Capotosto |
| 2009/0305852 | A1 | 12/2009 | Hoglund |
| 2011/0269607 | A1 | 11/2011 | Choi |

FOREIGN PATENT DOCUMENTS

| | | | |
|---|---|---|---|
| WO | 02/096522 | A1 | 12/2002 |
| WO | 2007/123461 | A1 | 11/2007 |
| WO | 2009/070084 | A1 | 6/2009 |
| WO | 2010/038959 | A1 | 4/2010 |

APPARATUS, SYSTEM, AND METHOD FOR A FITNESS STICK

CROSS-REFERENCES TO RELATED APPLICATIONS

This application is a continuation of and claims priority to U.S. patent application Ser. No. 13/346,583 entitled "APPARATUS, SYSTEM, AND METHOD FOR A FITNESS STICK" and filed on Jan. 9, 2012 for Li Si Yang et al., which is incorporated herein by reference.

TECHNICAL FIELD

This disclosure relates to exercise devices, and more particularly relates to a fitness stick for promoting proper form during physical exercise.

BACKGROUND

People exercise for a variety of reasons including strengthening muscles and the cardiovascular system, improving athletic abilities, weight loss, or merely for enjoyment or entertainment. Exercise also helps increase self-esteem by improving an individual's perception of their body.

Exercise can generally be grouped into three broad categories based on the overall effect they have on the body. The three groups are flexibility exercises, aerobic exercises, and anaerobic exercises. An individual's training regimen will combine exercises from each group according to the individual's goals. For example, a person training for a marathon will focus more on aerobic exercises than a weight lifter. Regardless of the goal, proper form is critical.

Form is a specific way of performing an exercise to avoid injury and increase strength. The lack of proper form will result in injury and furthermore reduces the desired effectiveness of the exercise. For example, many exercises are designed to target a specific group of muscles. The lack of proper form leads to the body utilizing secondary muscle groups and reducing the desired effectiveness of the exercise.

Proper form is also important in non-strength training exercises. For example, it is easy when doing yoga to make a mistake with even the most basic poses. This can lead to strains, sprains, and chronic aches. Therefore, it is important that a person practice proper form regardless of the type of exercise to minimize injury and maximize the desired effect.

SUMMARY

From the foregoing discussion, it should be apparent that a need exists for an apparatus and system that helps an exerciser maintain proper form throughout an entire range of motion.

The present disclosure has been developed in response to the present state of the art, and in particular, in response to the problems and needs in the art that have not yet been fully solved by currently available devices. Accordingly, the present disclosure has been developed to overcome many or all of the above-discussed shortcomings in the art.

The apparatus is provided with an elongated rod having a center point, a first end, and a second end. The apparatus includes an elongated rod, a first track, and a second track. The elongated rod has a center point, a first end, and a second end. The first track extends helically away from the center point along an outer surface of the elongated rod toward the first end. The second track extends helically away from the center point along the outer surface of the elongated rod toward the second end. The first track extends helically around the outer surface of the elongated rod in a first rotational direction and the second track extends helically around the outer surface of the elongated rod in a second rotational direction. The second rotational direction is opposite from the first rotational direction.

In one embodiment, any point along the second track is reflectively symmetrical to a corresponding point on the first track about a central plane extending through the center point and orthogonal to a longitudinal axis of the elongated rod. In another embodiment, the first and second tracks are embedded into the surface of the elongated rod and are substantially exposed for gripping. In a further embodiment, each track has a cross-sectional profile selected to engage the finger of a user. In one embodiment, the elongated rod is formed of at least two sections, the sections rigidly couplable to form the elongated rod.

In yet another embodiment, the apparatus also includes a first hand-slide having an attachment device, a hand grip, and a track guide. The attachment device may slidably couple the first hand-slide to the elongated rod. The track guide may be formed having a shape selected to engage the first track and maintain the first hand-slide in the same rotational orientation as the first track about the longitudinal axis of the elongated rod. The apparatus may also include a second hand-slide that is similar to the above described first hand-slide. In one embodiment, the apparatus includes a resistance band having a first end coupled with the first hand-slide and a second end coupled with the second hand-slide.

The system, in one embodiment, includes an elongated rod having a center point, a first end, and a second end, a first track extending helically away from the center point along an outer surface of the elongated rod toward the first end, a second track connected with the rod and extending helically away from the center point along an outer surface of the elongated rod toward the second end, first and second hand-slides, and a resistance band coupling the first and second hand-slides.

In another embodiment, the apparatus includes the elongated rod, first and second tracks, and at least two elongated sections rigidly couplable to form the elongated rod. In this embodiment, the tracks are formed in the surface of the elongated rod, each track having a cross-sectional profile selected to engage a track guide. In an alternative embodiment, the first and second tracks are embedded into the surface of the elongated rod and each is formed of a magnetic material selected to engage a ferromagnetic material. In one embodiment, the magnets are arranged to provide resistance against sliding. Alternatively, the first and second tracks are configured as teeth embedded in the surface of the elongated rod, the teeth selected to engage corresponding gears in a track guide. In another alternative embodiment, the first and second tracks are embedded into the surface of the elongated rod, each track having a cross-sectional profile selected to engage the finger of a user.

A method may be performed by a user using an apparatus or system as described above. The method may include providing a fitness stick that includes any of the features or aspects of the apparatus and system described above. In one embodiment, the method includes gripping the fitness stick with a first hand at a first location and a second hand at a second location, the first location and the second location equidistant from the center point of the fitness stick. The method may include sliding the hands relative to the stick such that the stick rotates with respect to the hands as determined by the first and second track. In one embodiment, the hands are maintained at substantially equal distance from the center point of the stick.

In one embodiment, first and second tracks of the fitness stick are embedded into surface of an elongated rod and are substantially exposed for gripping. In one embodiment, each track may include a cross-sectional profile selected to engage the finger of a user. In one embodiment, gripping the fitness stick includes engaging each of the tracks with one or more fingers. In a further embodiment, the method includes maintaining each of the one or more fingers in engagement with the tracks while sliding the hands relative to the stick.

In another embodiment, the fitness stick includes a first hand-slide and a second hand slide each having an attachment device, a hand grip, and a track guide. In one embodiment, gripping the fitness stick includes gripping the hand grip of the first hand-slide with the first hand and gripping the hand grip of the second hand slide with the second hand. The method may further includes maintaining the first hand on the first hand-slide and the second hand on the second hand-slide while sliding the hands relative to the stick.

Reference throughout this specification to features, advantages, or similar language does not imply that all of the features and advantages that may be realized with the present disclosure should be or are in any single embodiment of the disclosure. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the disclosure may be practiced without one or more of the specific features or advantages of a particular embodiment. In other instances, additional features and advantages may be recognized in certain embodiments that may not be present in all embodiments of the disclosure.

These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. In the following description, numerous specific details are provided to offer a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

Figure 1:
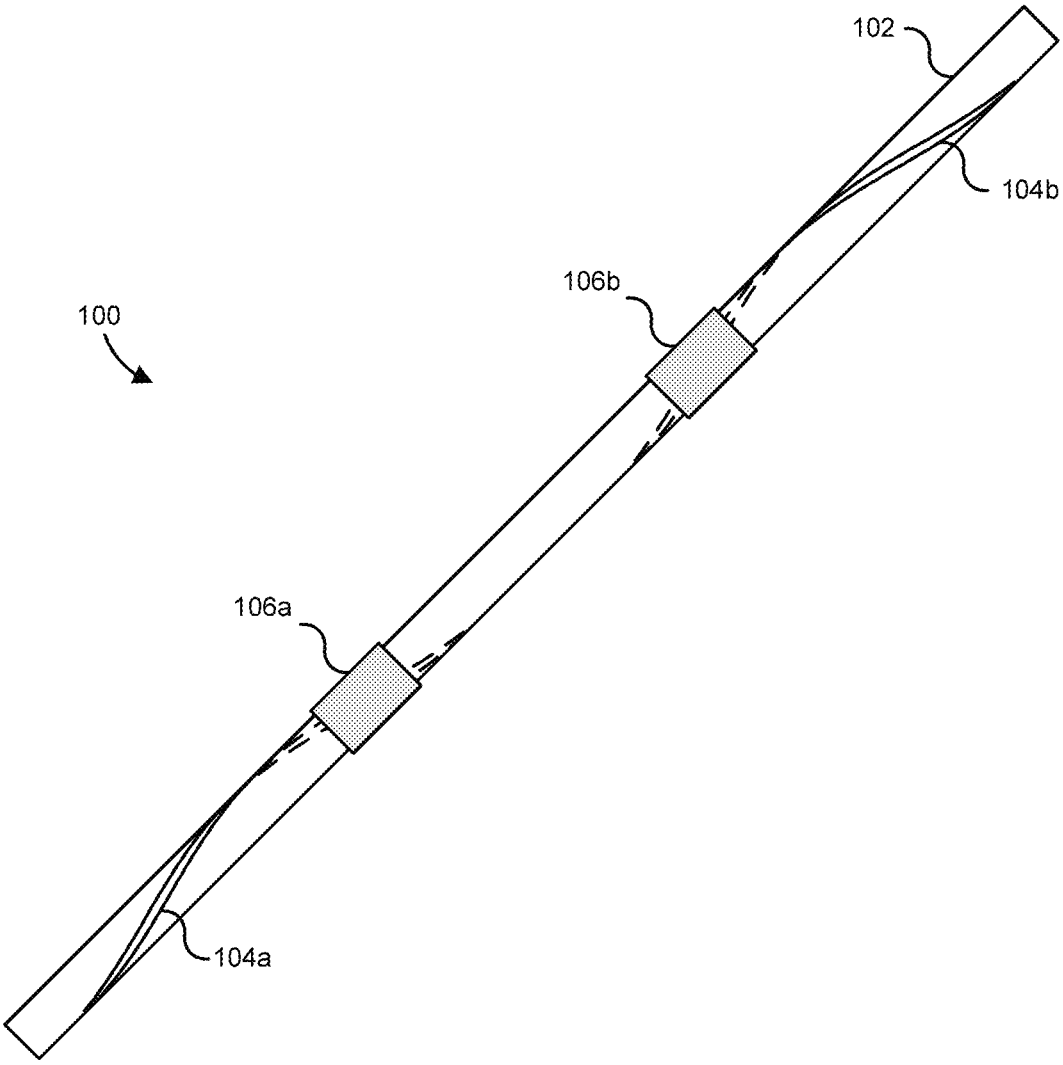
FIG. 1 is a front view of a fitness stick.

FIG. 1 illustrates one embodiment of a fitness stick 100. The fitness stick 100 facilitates a series of exercises while helping the exerciser maintain correct form. Also, the fitness stick helps users stretch and move their body through a full range of motion, thereby improving a user's lifestyle. In certain embodiments, the fitness stick 100 may comprise an elongated rod 102, tracks 104*a* and 104*b*, and hand-slides 106*a*, 106*b*.

The elongated rod 102 is a lengthened shaft of rigid material. For example, the elongated rod 102 may be a cylindrical wooden rod with a diameter in the range of between about 1 and 3 inches. In one embodiment, the diameter of the elongated rod is about 1⅜ inches (3.49 cm). The elongated rod has a length of about two yards (1.82 m). The elongated rod 102 may comprise any length or diameter. For instance, a manufacturer of the elongated rod 102 may customize the diameter and length to match the preferences of a particular exerciser. A taller user may require a longer elongated rod 102, while a user with small hands may require an elongated rod 102 with a smaller diameter.

Further, the elongated rod 102 may be formed of any rigid material. In other words, the elongated rod 102 may be manufactured from wood, metal, fiberglass, plastic, carbon fiber, and the like. Also, the elongated rod 102 has a weight selected according to a user's specification. For example, a user may desire a heavier rod to increase muscular resistance during exercising.

In certain embodiments, the fitness stick 100 includes tracks 104*a-b*. The tracks 104*a-b* are formed by grooves that extend away from the longitudinal center of the elongated rod 102. The term "tracks," as used herein, refers to a longitudinally-running indentation or channel in the surface of the elongated rod 102. Further, the tracks 104*a-b* may spiral around the longitudinal axis of the elongated rod 102 as the tracks 104*a-b* extend away from the center of the elongated rod 102.

In one embodiment, the track 104*a* may begin at a specified starting point near the center of the elongated rod 102. The track 104*a* ends at a specified ending point near the end of the elongated rod 102, where the ending point is on the same side of the elongated rod 102 as the starting point. The starting point is also closer to the center of the elongated rod 102 than the ending point. In certain embodiments, the starting point may be the same as the center point of the elongated rod 102. In a further embodiment, the ending point may be one end of the elongated rod 102.

In at least one embodiment, the track 104*b* is reflectively symmetrical with the track 104*a* about a plane extending through the center of the elongated rod 102 and orthogonal to the longitudinal axis of the elongated rod 102. In other words, a point lying on the track 104*a* has the same coordinates in a plane orthogonal to the longitudinal axis as a point lying on the track 104*b*. The points on the track 104*a* lie the same distance from the center point along the longitudinal axis as the points on the track 104*b* but in an opposite direction from the center point along the longitudinal axis. In an alternative embodiment, the track 104*b*, after reflecting the track 104*a* through the plane, may be rotationally offset around the longitudinal axis.

In certain embodiments, hand-slides 106*a-b* may fasten to the elongated rod 102. The term "hand-slides," as used herein, refers to a slidable mechanism that permits a user to grasp the elongated rod 102 at specific locations. Further, the hand-slides 106*a-b* may rotate around the longitudinal axis of the elongated rod 102 at the same rotational rate as the tracks 104*a-b*. The hand-slides 106*a-b* may maintain the same rotational orientation as the tracks 104*a-b* by extending a guide into the tracks 104*a-b*. The guide prevents the hand-slides 106*a-b* from rotating about the elongated rod but allows the hand-slides to move along the longitudinal axis of the elongated rod 102. By grasping the hand-slides 106*a-b*, a user can maintain the center point of the elongated rod 102 at the same position between their hands, while keeping their hands at the same rotational position.

Figure 2:
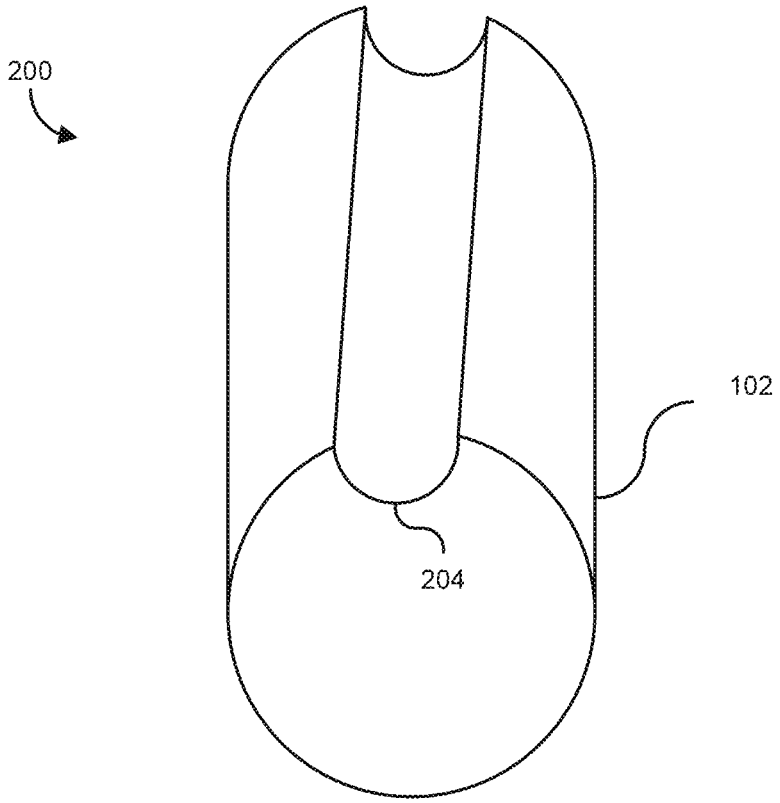
FIG. 2 is a perspective view of a cross section of the fitness stick.

FIG. 2 illustrates a cross section 200 of the elongated rod 102 according to one embodiment. The cross section 200 may comprise a track 204 and the elongated rod 102. According to one embodiment, the track 204 may run at a slight angle in relation to the longitudinal axis of the elongated rod 102. The angle of the track may comprise any pitch that requires the hand grips to be at mirrored locations about the center plane of the elongated rod 102. For example, the track 204 may only revolve around the elongated rod 102 once. By going around the elongated rod only once, every rotational position on one side of the center point of the elongated rod 102 is unique. Therefore, when an exerciser uses a hand-slide, their hands are always located at mirrored locations about the center plane of the elongated rod 102.

The track 204, in one embodiment, revolves around the elongated rod 102 multiple times. For example, the track 204 may encircle the elongated rod two times. The number of revolutions that the track 204 revolves around the elongated rod 102 is selected according to a user's preferences.

Figure 3:
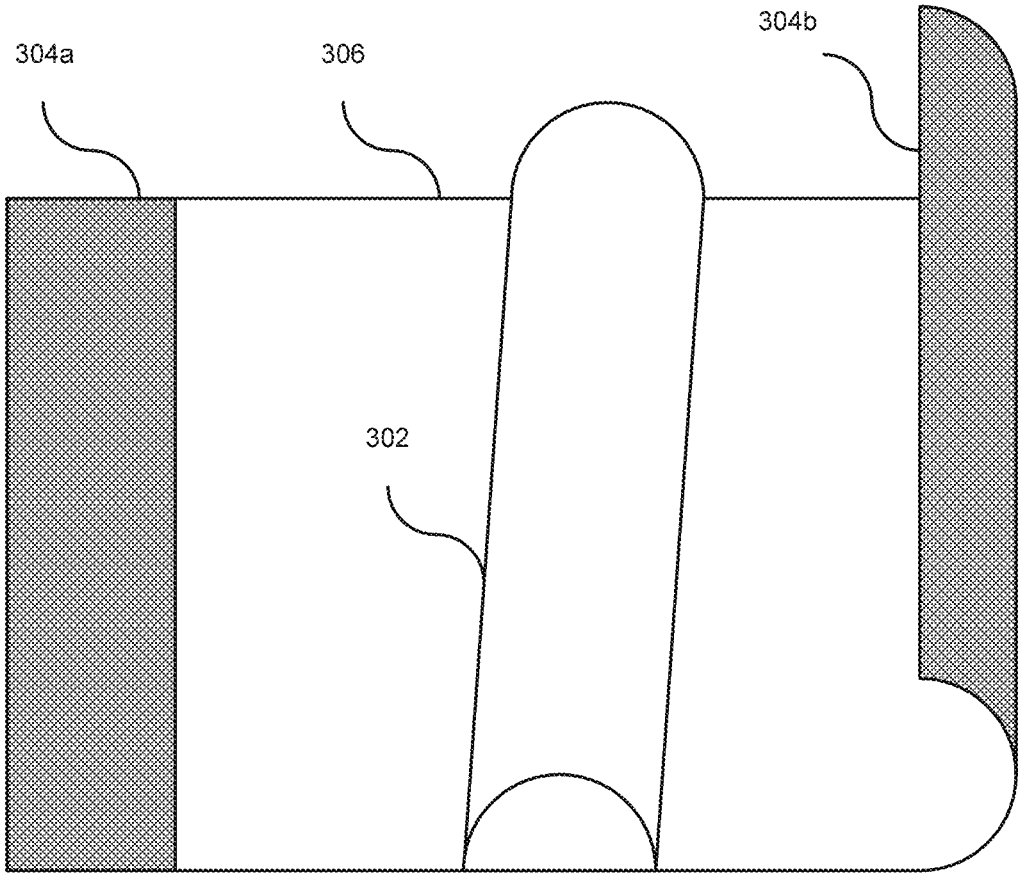
FIG. 3 illustrates a detachable hand grip.

FIG. 3 is a perspective view diagram illustrating a hand-slide 306. The hand-slide in FIG. 3 includes a track guide 302, and attaching surfaces 304*a-b*. In at least one embodiment, the hand-slide 306 is formed from fabric. In a further embodiment, the hand-slide 306 may be made from plastic, metal, leather, and the like.

In certain embodiments, the hand-slide 306 may comprise a track guide 302. The track guide 302 is a thicker portion of the hand-slide 306 that is contoured to engage the track 204. By engaging the track 204, the track guide 302 prevents the hand-slide from rotating around the longitudinal axis of the elongated rod 102 unless the hand-slide 306 moves longitudinally along the track 204. When the hand-slide 306 moves longitudinally along the track 204, the hand-slide 306 may rotate around the longitudinal axis of the elongated rod 102 at the same rate that the track 204 rotates around the longitudinal axis of the elongated rod 102.

The track guide 302, for example, comprises a pouch attached to the hand-slide 306. The pouch may contain any material that helps it maintain a shape that matches the shape of the track 204. For example, beans may fill the pouch. Alternatively, the pouch may contain sand, beads, paper, plastic, and the like. In a further embodiment, the track guide 302 is formed of a molded piece of material shaped to fill the track 104. The molded material may comprise plastic, metal, wood, and the like.

In certain embodiments, the hand-slide 306 detaches from the elongated rod 102. When the hand-slide 306 detaches from the elongated rod 102, the hand-slide 306 may include attachable surfaces 304*a-b*. The attachable surface 304*a* engages the attachable surface 304*b*. The attachable surfaces 304*a-b* may attach to one another with hook and loop fasteners, buckles, zippers, laces, buttons, and the like. In at least one embodiment, where the track 204 extends to the end of the elongated rod 102, the hand-slide 306 may detach by sliding off the end of the elongated rod 102.

In a further embodiment, the hand-slide 306 is not detachable from the elongated rod 102. In this embodiment, the hand-slide 306 is manufactured from any material as outlined above. In one embodiment, the hand-slide 306 may be molded from a material such as plastic or metal. Further, the hand-slide 306 comprises a gripping surface applied to the hand-slide, the gripping surface aides a user in grasping the hand-slide 306 more effectively.

Figure 4:
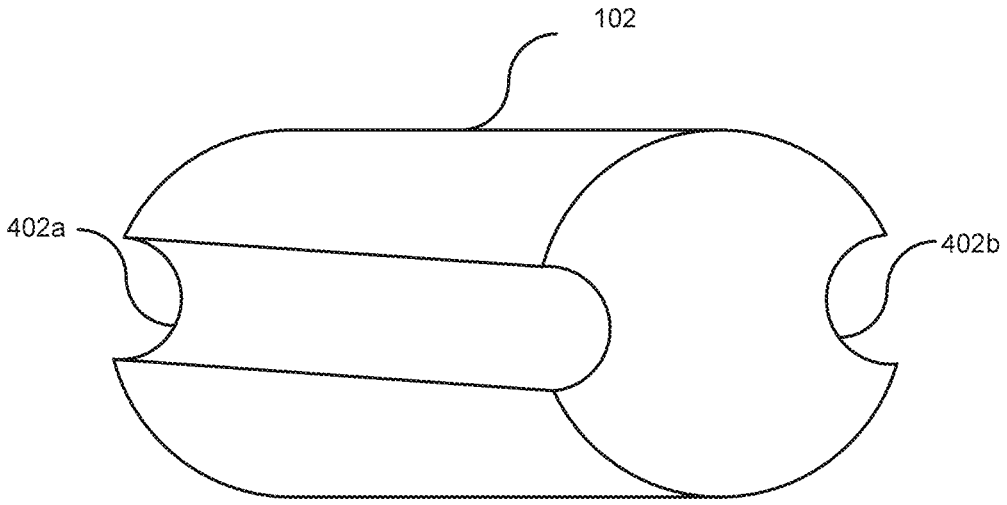
FIG. 4 shows a perspective view of a cross section of the fitness stick equipped with two tracks.

FIG. 4 illustrates one embodiment of the elongated rod 102 having a plurality of tracks on each side of the center point of the elongated rod 102. In certain embodiments, the elongated rod 102 may comprise the tracks 402*a-b*. The tracks 402*a-b* may rotate at the same rotational rate around the elongated rod 102. The tracks 402*a-b* run parallel to one another along the elongated rod 102. Further, the track 402*a* may lie on the opposite side of the elongated rod 102 from the track 402*b*. In another embodiment, the track 402*a* and the track 402*b* may lie at any position around the circumference of the elongated rod 102. For example, the circumference of the elongated rod 102 may be five inches.

The center of the track 402*a* may lie one inch along the circumference of the elongated rod 102 from the center of track 402*b*. In other words, the distance between the two tracks, taken along the circumference of the rod, is a constant one inch. Alternatively, the center of the track 402*a* may lie 2.5 inches away from the center of the track 402*b* along the circumference of the elongated rod 102. Further, in at least one embodiment, the center of the track 402*a* may lie 1.6 inches away from the center of the track 402*b* along the circumference of the elongated rod 102, and the center of the track 402*b* may lie 1.7 inches away from the center of a third track along the circumference of the elongated rod 102. The tracks may run parallel to one another throughout their length.

Figure 5:
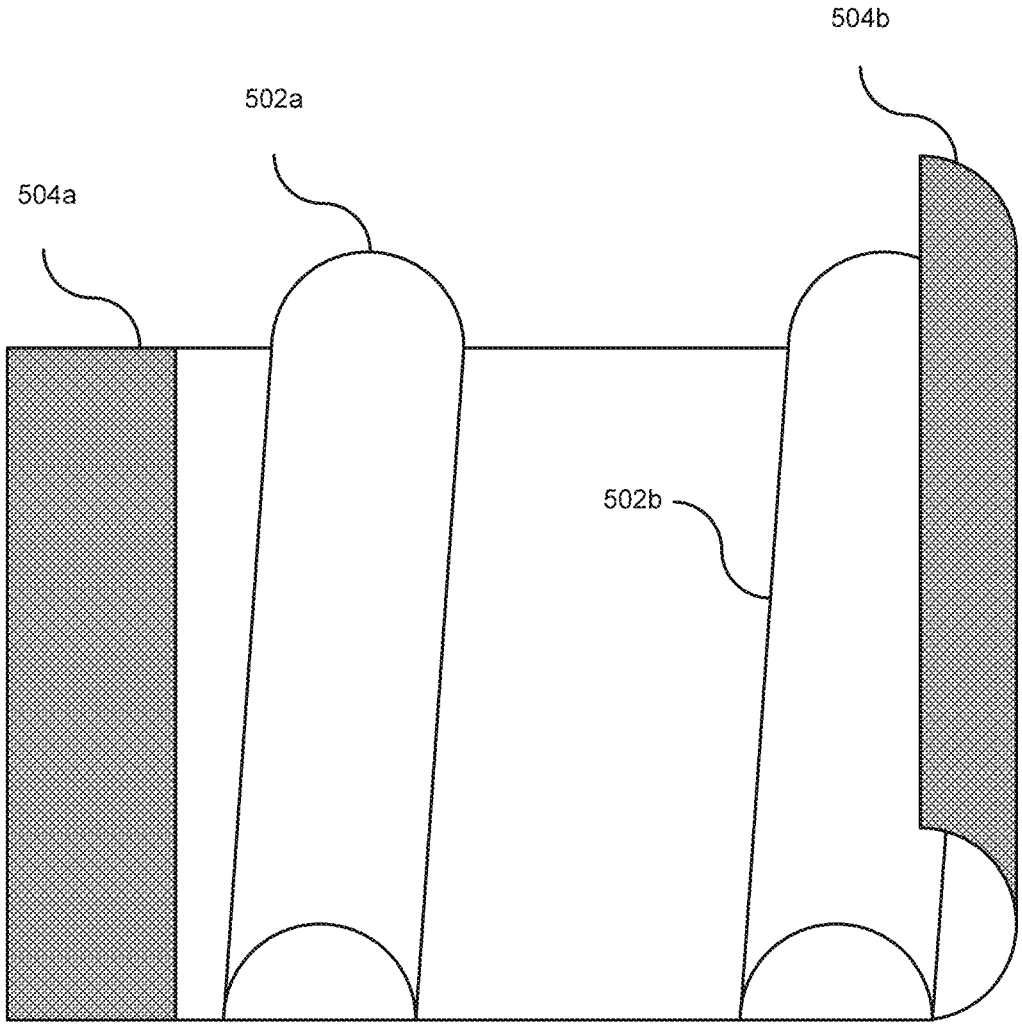
FIG. 5 illustrates a hand-slide equipped with two track guides.

FIG. 5 illustrates a hand-slide designed to slide on an elongated rod 102 with multiple tracks as shown in FIG. 4. The hand-slide 500 may comprise an attaching surface 504*a* and an attaching surface 504*b*, where the attaching surfaces 504*a-b* function similarly to the attaching surfaces 304*a-b* in FIG. 3. Further, the hand-slide may comprise the track guides 502*a-b*, where the track guides function similarly to the track guide 302 in FIG. 3. The track guides 502*a-b* may fit into the locations of multiple tracks as described in relation to FIG. 4. For example, when two tracks rotate around the elongated rod 102, the track guides 502*a-b* may fill in the two different tracks. The hand-slide 500 may comprise a number of track guides 502 which correspond to the number of tracks rotating around the elongated rod 102.

Figure 6A:
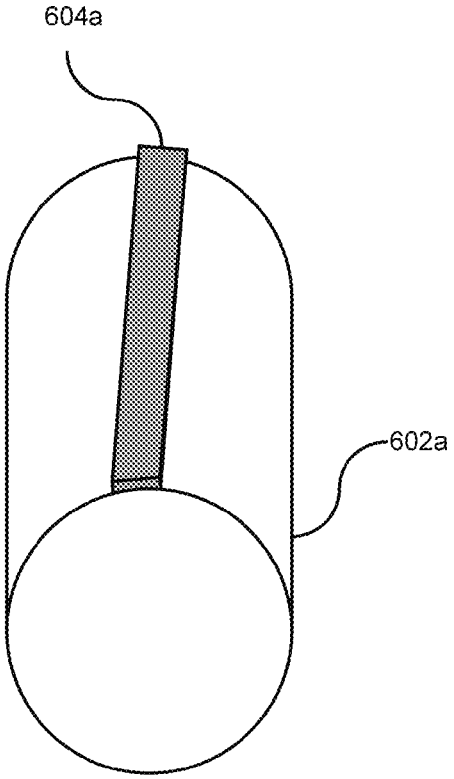
FIG. 6*a* is a perspective view of a cross section of the fitness stick equipped with a magnetic track.
Figure 6B:
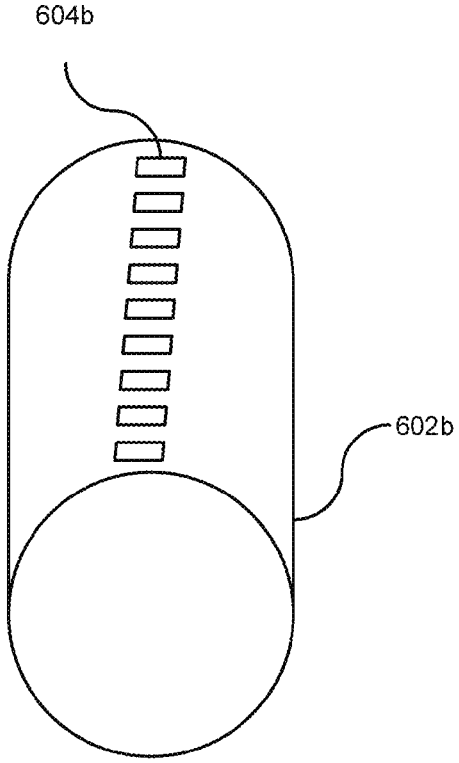
FIG. 6*b* is a perspective view of a cross section of the fitness stick equipped with a gear track.
Figure 6C:
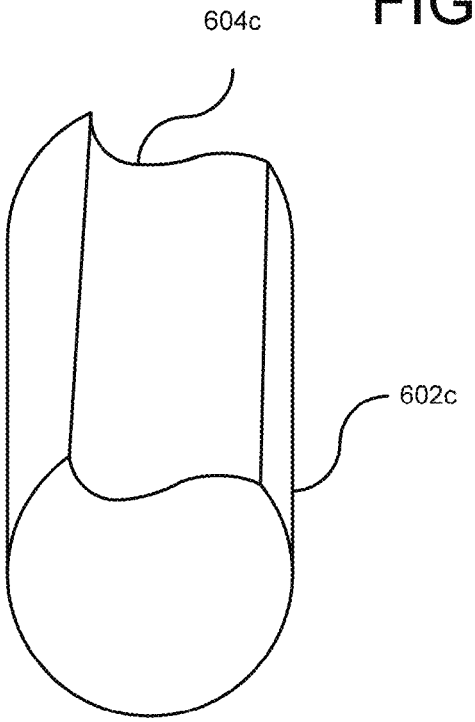
FIG. 6*c* is a perspective view of a cross section of the fitness stick equipped with a finger track.
Figure 7A:
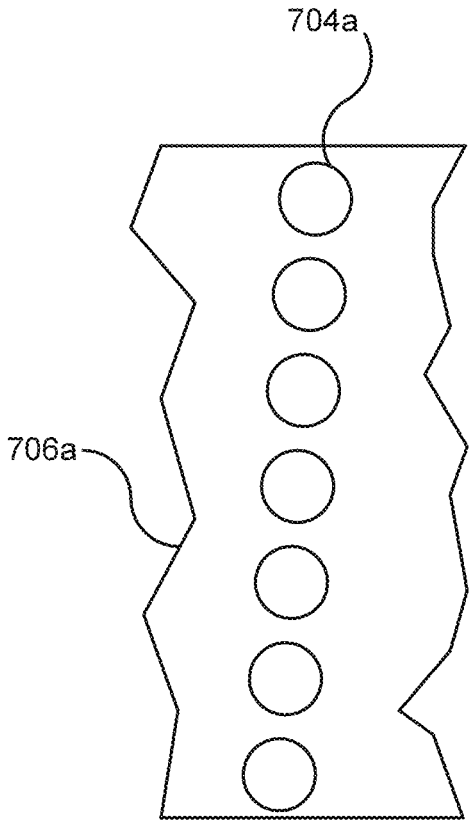
FIG. 7*a* illustrates a hand-slide equipped with a magnetic slider.
Figure 7B:
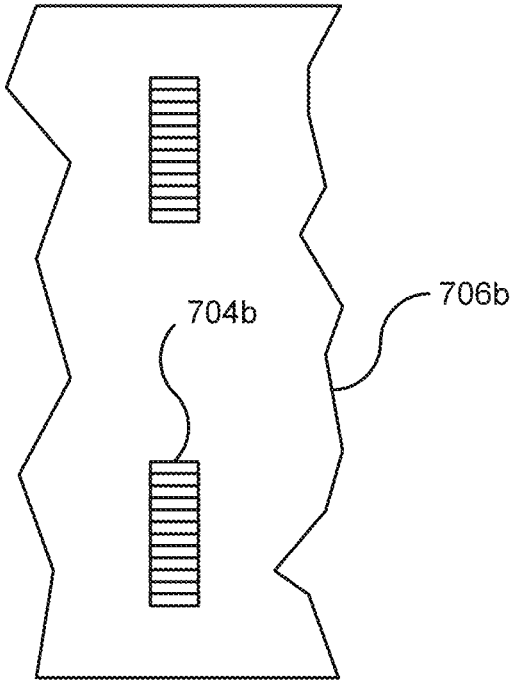
FIG. 7*b* illustrates a hand-slide equipped with a gear slider.

In a further embodiment, FIGS. 6*a-c* and 7*a-b* illustrate alternative embodiments of the track along with corresponding hand-slides. FIGS. 6*a-c* illustrate tracks on an elongated rod according to various embodiments, while FIGS. 7*a-b* illustrate hand-slides according to various embodiments.

FIG. 6*a* shows an elongated rod 602*a* equipped with a magnetic track 604*a*. The magnetic track 604*a* spirals around the elongated rod 602*a* similarly to the way that the track 102*a* in FIG. 1 spirals around the elongated rod 102. The magnetic track 604*a* may comprise a metal attracted by a magnet, a magnetic material, a mixture of metal and magnetic material, and the like. Further, the magnetic track 604*a* may extend away from the elongated rod 602*a*, be embedded into the surface of the elongated rod 602*a*, be contained in a protective case, and the like.

Similarly, FIG. 7*a* shows a hand-slide 706*a* equipped with a magnetic slider 704*a*. The magnetic slider 704*a* may slide along the surface of the magnetic track 604*a*, spiraling around the elongated rod 602*a* at the same rate that the magnetic track 604*a* spirals around the elongated rod 602*a*. The magnetic slider 704*a*, in one embodiment, is a series of magnets attached to the hand-slide 706*a*. For example, a series of molybdenum magnets may be sown into a fabric hand-slide 706*a* at a pitch that matches the pitch of the magnetic track 604*a*. In certain embodiments, the magnetic slider 704*a* may comprise one solid magnet, a series of magnets, a metal attracted by magnets, and the like. In another embodiment, the magnets may be arranged to provide resistance against sliding, to increase exertion during a workout.

FIG. 6*b* shows an elongated rod 602*b* equipped with a gear track 604*b*. The gear track 604*b* spirals around the elongated rod 602*b* in a manner similar to the track 102*a* of FIG. 1. The gear track 604*b* may comprise a series of small grooves designed to receive gear teeth. Further, the teeth of the gear track 604*b* may be indentations in the wood, inlaid metal, and the like.

FIG. 7*b* shows a hand-slide 706*b* equipped with a gear slider 704*b*. The gear slider may comprise a series of rotating gears that engage the gear track 604*b*. The gears in the gear slider 704*b* may rotate as the gear teeth move through the gear track 604*b*. As the hand-slide 706*b* moves along the surface of the elongated rod 602*b*, the hand-slide 706*b* may spiral around the elongated rod 602*b* at the same rate that the gear track 604*b* spirals around the elongated rod 602*b*. In certain embodiments, the gear slider 704*b* may comprise gears manufactured from plastic, metal, wood, ceramic, and the like.

FIG. 6*c* shows an elongated rod 602*c* equipped with a finger track 604*c*. The finger track 604*c* spirals around the elongated rod 602*c* similarly to the way that the track 102*a* in FIG. 1 spirals around the elongated rod 102. The finger track 604*c* may comprise a groove that is contoured to allow a human finger to slide through the track, removing the need for a hand-slide. Further, to allow fingers to slide through the finger track 604*c*, the finger track 604*c* may be inlaid with a friction reducing material, including wax, polished metal, plastic, polished wood, and the like.

Figure 8:
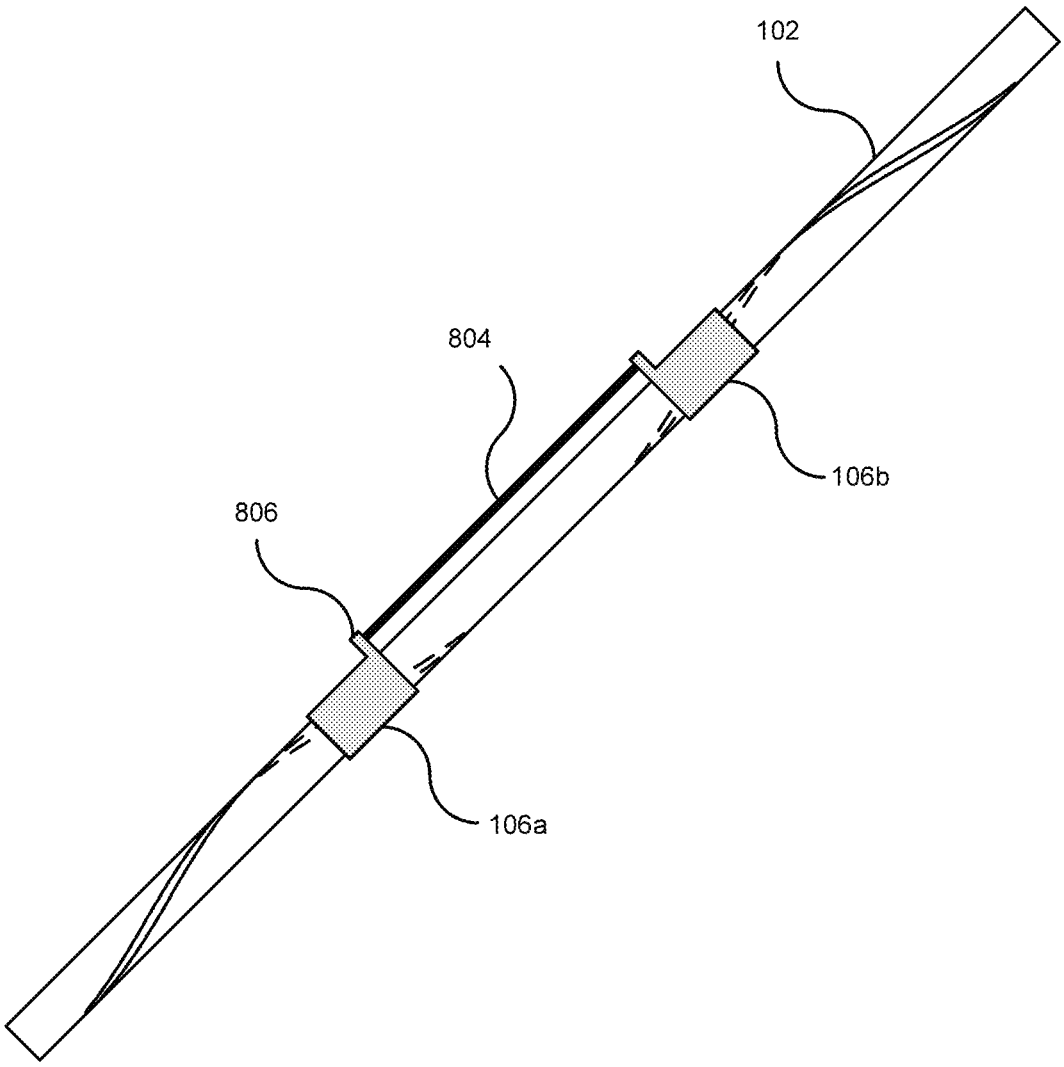
FIG. 8 illustrates the fitness stick equipped with a resistance mechanism.

FIG. 8 illustrates a further embodiment of the hand-slide, particularly when resistance inhibits the motion of the hand-slides along the elongated rod 102. In FIG. 8, the hand-slides 106*a-b* further comprise a resistance band fastener 806. Also, a resistance band 804 may connect the hand-slide 106*a* to the hand-slide 106*b*.

In certain embodiments, the resistance band fastener 806 may comprise a mechanism that secures the resistance band 804 to the hand-slides 106*a-b*. For example, the resistance band 804 may attach to the hand-slides 106*a-b* with hooks, hook and loop fasteners, notches, snaps, and the like. In at least one embodiment, the resistance band may permanently connect to the hand-slides 106*a-b*. In this embodiment, the resistance band fastener 806 may comprise a molded connection point that connects to the resistance band 804. In another embodiment, the hand-slides 106*a-b* may connect to other forms of resistance. For example, the resistance bands may connect to a cable pulley system, where the cable pulley system connects to weight resistance. The hand-slides may connect to other forms of resistance including a plurality of resistance bands, bendable rods, and the like.

Figure 9:
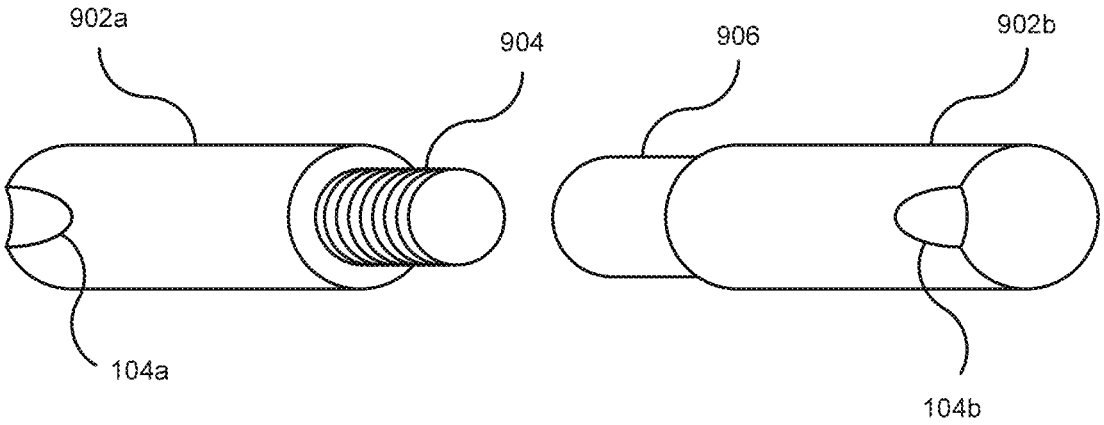
FIG. 9 illustrates the collapsibility of the fitness stick.

FIG. 9 shows that the fitness stick may separate into different sections for storage and transportation. For example, the fitness stick 900 may comprise elongated rods 902*a-b*, a male rod fastener 904, a female rod fastener 906, and tracks 104*a-b*. The tracks 104*a-b* function as identified above.

In certain embodiments, the fitness stick 900 may detach into two separate pieces, an elongated rod 902*a* and an elongated rod 902*b*. The elongated rod 902*a* may comprise a male rod fastener 904 and the elongated rod 902*b* may comprise a female rod fastener 906. The elongated rod 902*a* may connect to the elongated rod 902 *b*. To connect the elongated rods 902*a-b*, the male rod fastener 904 may fit into the female rod fastener 906. The male rod fastener 904 and the female rod fastener may connect in different ways, including threaded fasteners, sockets, and the like. When the elongated rod 902*a* connects to the elongated rod 902*b*, the tracks 104*a-b* must be reflectively symmetrical as previously described.

Figure 10:
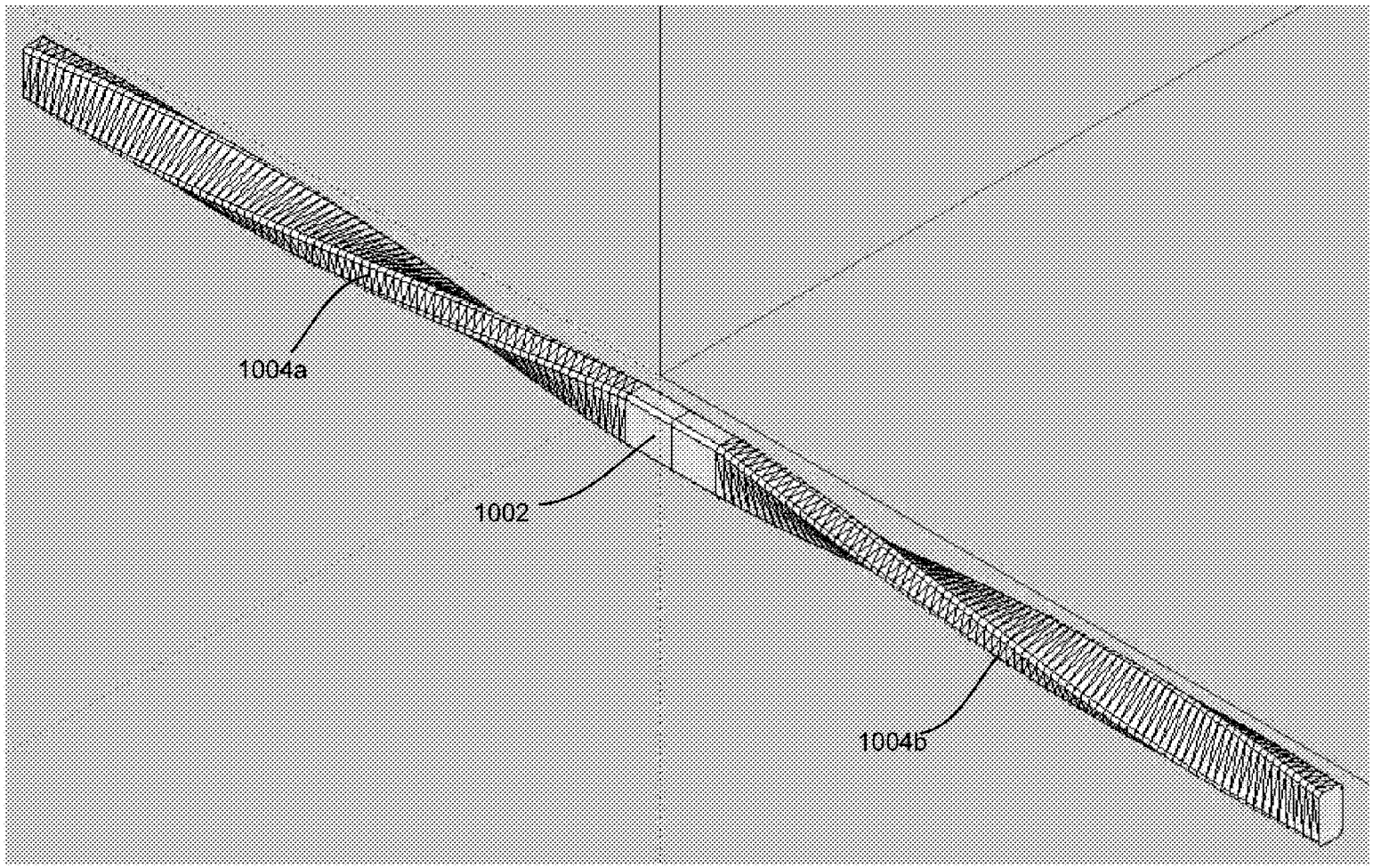
FIG. 10 illustrates one exemplary embodiment of a fitness stick.

FIG. 10 illustrates another exemplary embodiment of a fitness stick 1002. The fitness stick 1002 may be formed of any material such as wood, plastic, carbon fiber, or any other material. The fitness stick 1002 includes a rectangular cross section which rotates with respect to a longitudinal axis of the stick. According to one embodiment, surfaces of the stick that are separated by corners of the cross section form first and second tracks 1004*a*, 1004*b*. In at least one embodiment, the fitness stick 1002 may also include a hand-slide. For example, a hand-slide made of flexible cloth may be used to reduce friction between a hand of a user and the tracks 1004*a*, 1004*b* of the fitness stick 1002.

Figure 11:
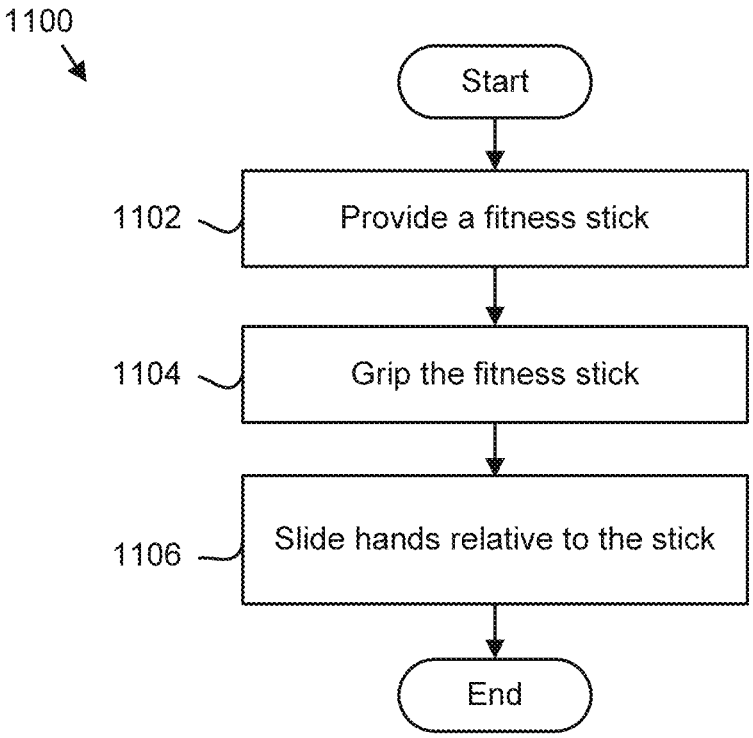
FIG. 11 illustrates a method of using a fitness stick, according to one embodiment.

FIG. 11 illustrates a method 1100 of using a fitness stick, according to one embodiment. In one embodiment, the method 1100 may be performed by a user of a fitness stick, such as those depicted in FIGS. 1, 8, 9, and 10. In one embodiment, the method 1100 of FIG. 11 may help a user to maintain proper form while performing an exercise. For example, the user may be assisted in maintaining the user's hands at an equal distance from a center point of an elongated rod. This may encourage equal stretching of limbs and/or an equal balance of weight.

In one embodiment, the method 1100 includes providing 1102 a fitness stick 102. The fitness stick may be any apparatus or system having any of the variations disclosed herein. In one embodiment, the fitness stick may include an elongated rod having a center point, a first end, and a second end. The fitness stick may include a first track extending helically away from the center point along an outer surface of the elongated rod toward the first end. The fitness stick may include a second track extending helically away from the center point along the outer surface of the elongated rod toward the second end. In one embodiment, the first track extends helically around the outer surface of the elongated rod in one rotational direction and the second track extends helically around the outer surface of the elongated rod in an opposite rotational direction. For example, FIGS. 1 and 10 illustrate tracks that extend around rods in opposite rotational directions. In one embodiment, the opposite rotational directions allows the tracks to be engaged by hands or hand-slides while a distance between the hands or hand-slides is varied.

In one embodiment, the method 1100 may include gripping 1104 the fitness stick. A user may grip 1104 the fitness stick by grasping the stick with one hand at a first location and with a second hand at a second location. In one embodiment, the two locations are equidistant with respect to a center point of the stick. In one embodiment, the locations for gripping 1104 the stick are at least partially determined by the tracks. For example, the stick may include finger tracks 604*c* that are reflectively symmetrical about a central plane extending through the center point and orthogonal to a longitudinal axis of the elongated rod. The user may grip 1104 the stick such that a finger, such as a thumb or any other finger, engages the finger tracks 604 at reflectively symmetrical locations. In one embodiment, gripping 1104 the stick at equidistance locations may include engaging one or more fingers of a first hand at a first location of a first track and engaging one or more fingers of a second hand at a second location. The first location and second locations engaged by the fingers may be reflectively symmetrical points on the respective tracks. In one embodiment, the stick may include hand-slides 106*a*, 106*b* rather than finger tracks 604*c*. In such an embodiment, a user may grip 1104 the hand-slides when the hand slides are equidistant from a center of the stick.

The method 1100 may include sliding 1106 the user's hands relative to the stick such that the stick rotates with respect to the hands as determined by the first and second track. For example, if a user engages the tracks with a finger, or grips a hand-slide the tracks may cause the stick to rotate with respect to the hands. The user may slide 1106 the user's hands such that the hands are maintained at substantially equal distance from the center point of the stick. For example, if the user's fingers engage the track at reflectively symmetrical locations, the user's hands may be maintained at equal distances from the center point of the stick. The distance between the hands may vary as the hands are slid 1106. As another example, if the user grips hand-slides 106*a*, 106*b* and moves the hand slides with the user's hands relative to the stick, the user's hands may be equidistant from a center of the stick as long as the user does not rotate a first hand-slide 106*a* with respect to a second hand-slide 106*b*.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus comprising:

an elongated rod having a center point, a first end, and a second end;

a first track extending helically away from the center point along an outer surface of the elongated rod toward the first end, wherein the first track comprises an elongated indentation; and a second track extending helically away from the center point along the outer surface of the elongated rod toward the second end, wherein the first track extends helically around the outer surface of the elongated rod in a first rotational direction and the second track extends helically around the outer surface of the elongated rod in a second rotational direction, the second rotational direction opposite from the first rotational direction, wherein any point along the second track is reflectively symmetrical to a corresponding point on the first track about a central plane extending through the center point and orthogonal to a longitudinal axis of the elongated rod.

2. The apparatus of claim 1, wherein the first and second tracks are embedded into the outer surface of the elongated rod and are substantially exposed for gripping, each track having a cross-sectional profile selected to engage a finger of a user.

3. The apparatus of claim 1, wherein the elongated rod is formed of at least two sections, the sections rigidly couplable to form the elongated rod.

4. The apparatus of claim 1, further comprising a first hand-slide having an attachment device, a hand grip, and a track guide.

5. The apparatus of claim 4, wherein the attachment device slidably couples the first hand-slide to the elongated rod.

6. The apparatus of claim 4, wherein the track guide is formed having a shape selected to engage the first track and maintain the first hand-slide in the same rotational orientation as the first track about the longitudinal axis of the elongated rod.

7. The apparatus of claim 4, further comprising a second hand-slide having an attachment device, a hand grip, and a track guide.

8. The apparatus of claim 7, further comprising a resistance band having a first end coupled with the first hand-slide and a second end coupled with the second hand-slide.

9. A fitness system comprising:

an elongated rod having a center point, a first end, and a second end;

a first track extending helically away from the center point along an outer surface of the elongated rod toward the first end, wherein the first track is embedded into the outer surface of the elongated rod and is formed of a magnetic material; and a second track extending helically away from the center point along the outer surface of the elongated rod toward the second end, wherein the second track is embedded into the outer surface of the elongated road and is formed of the magnetic material, wherein the first track extends helically around the outer surface of the elongated rod in a first rotational direction and the second track extends helically around the outer surface of the elongated rod in a second rotational direction, the second rotational direction opposite from the first rotational direction.

10. The system of claim 9, wherein any point along the second track is reflectively symmetrical to a corresponding point on the first track about a central plane extending through the center point and orthogonal to a longitudinal axis of the elongated rod.

11. The system of claim 9, further comprising a first hand-slide having an attachment device comprising a ferromagnetic material selected to engage the magnetic material.

12. The system of claim 9, wherein the magnetic material comprises a plurality of magnets that are each arranged to provide resistance against the sliding hand-slide.

* * * * *